US006327837B1

(12) United States Patent
Van Erden

(10) Patent No.: US 6,327,837 B1
(45) Date of Patent: Dec. 11, 2001

(54) SLIDE-ZIPPER ASSEMBLY WITH PEEL SEAL AND METHOD OF MAKING PACKAGES WITH SLIDE ZIPPER ASSEMBLY

(75) Inventor: Donald L. Van Erden, Wildwood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/354,397

(22) Filed: Jul. 15, 1999

(51) Int. Cl.[7] ..... B65B 61/18

(52) U.S. Cl. ..... 53/412; 53/451; 53/133.4; 53/139.2

(58) Field of Search ..... 53/412, 451, 133.4, 53/139.2, 551, 552; 156/66; 493/213, 927

(56) References Cited

U.S. PATENT DOCUMENTS

| | | | | |
|---|---|---|---|---|
| 4,601,694 | * | 7/1986 | Ausnit | 53/139.2 |
| 4,894,975 | * | 1/1990 | Ausnit | 53/139.2 |
| 4,909,017 | * | 3/1990 | McMahon et al. | 53/133.4 |
| 5,400,568 | * | 3/1995 | Kanemitsu et al. | 53/133.4 |
| 5,492,411 | * | 2/1996 | May | 493/213 |
| 5,613,934 | * | 3/1997 | May | 493/213 |
| 5,782,733 | * | 7/1998 | Yeager | 493/213 |
| 5,816,018 | * | 10/1998 | Bois | 53/133.4 |
| 5,956,924 | * | 9/1999 | Thieman | 53/412 |
| 6,000,197 | * | 12/1999 | Ausnit | 53/412 |

FOREIGN PATENT DOCUMENTS

516393 * 12/1992 (EP) .

* cited by examiner

*Primary Examiner*—John Sipos
(74) *Attorney, Agent, or Firm*—Pitney, Hardin, Kipp & Szuch LLP

(57) ABSTRACT

A reclosable zipper is provided. The reclosable zipper is comprised of a first profile interlockable with a second profile. Each profile includes an interlocking member and a flange extending from the interlocking member on one side thereof. One of the zipper flanges is longer than the other and the zipper flanges are attached together by a peel seal. A slider may optionally be included for opening and closing the zipper. Lengths of the reclosable zipper are attached to a length of thermoplastic film via the longer zipper flange, either transverse or parallel to a running direction of the film, to form a supply of package making material. The supply of package making material is fed into an FFS machine or the like where it is made into reclosable packages.

8 Claims, 10 Drawing Sheets

SLIDE-ZIPPER ASSEMBLY WITH PEEL SEAL AND METHOD OF MAKING PACKAGES WITH SLIDE ZIPPER ASSEMBLY

BACKGROUND OF THE INVENTION

1. Field of the Invention

The present invention relates to the field of reclosable packaging. More particularly, the present invention relates to a slide-zipper assembly and a method of making packages with the slide-zipper assembly, preferably on a form-fill-seal (FFS) machine.

2. Description of the Prior Art

Slide-zipper assemblies are well-known in the reclosable packaging art, such as those slide-zipper assemblies disclosed in U.S. Pat. Nos. 5,007,143, 5,008,971, 5,131,121 and 5,664,299. Methods of making reclosable packages on FFS machines are likewise well-known in the reclosable packaging art, such as those methods disclosed in U.S. Pat. Nos. 4,909,017, 4,655,862 and 4,894,975.

Because of the facility which is provided by slide-zippers to consumers of reclosable packages and because of the large volume of reclosable packages made on FFS machines today, it is highly desirable and advantageous to combine the two technologies so that slide-zippered packages can be made on FFS machines.

SUMMARY OF THE INVENTION

Accordingly, an object of the present invention is to provide a new type of slide-zipper assembly particulary suited for use in the manufacture of slide-zippered packages on FFS machines. Another object of the present invention is to provide a supply of package making material which can be used to make packages which utilize the slide-zipper assembly. Another object of the present invention is to provide a method of making packages which utilize the slide-zipper assembly, preferably on an FFS machine.

According to a first aspect of the present invention, a reclosable zipper is provided. The reclosable zipper is comprised of a first profile interlockable with a second profile. Each profile includes an interlocking member and a flange extending from the interlocking member on one side thereof. The zipper flanges extend in the same direction and are connected together by a peel seal. Additionally, one of the flanges is longer than the other in order to facilitate attachment of the slide-zipper assembly to thermoplastic film which will later be formed into a package. Optionally, a slider may be included for opening and closing the zipper. The slider straddles the zipper and is adapted to open the zipper as it is moved therealong in an opening direction and to close the zipper as it is moved therealong in a closing direction.

According to a second aspect of the present invention, lengths of the reclosable zipper are attached to thermoplastic film via the longer zipper flange, which thermoplastic film can later be used to make reclosable packages.

According to a third aspect of the present invention, the zipper-equipped thermoplastic film is fed into an FFS machine or the like and made into reclosable packages.

The present invention will now be described in detail, with frequent reference being made to the drawings identified below in which the same numerals represent the same elements.

DETAILED DESCRIPTION OF THE PREFERRED EMBODIMENT

Figure 1:
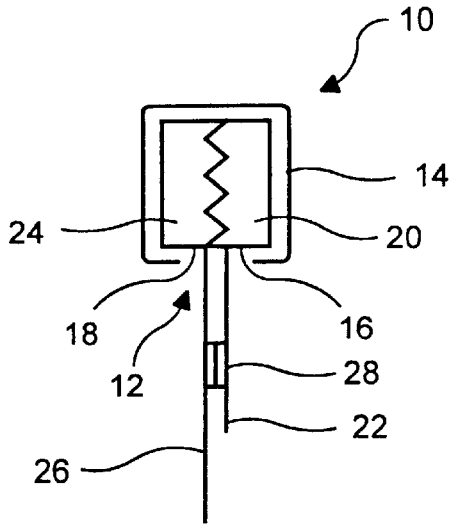
FIG. 1 is a cross-sectional view of a length slide-zipper assembly in accordance with the present invention.

In accordance with the present invention, a cross-sectional view of a length of slide-zipper assembly 10 is shown in FIG. 1. The slide-zipper assembly 10 includes a reclosable zipper 12 and a straddling slider 14. The slider 14 is adapted to open the zipper 12 as it is moved therealong in an opening direction and to close the zipper 12 as it is moved therealong in a closing direction. Although the slider 14 is included in the preferred embodiment, the slider 14 is optional and is not necessary to practice the present invention.

The zipper 12 includes a first profile 16 and a second profile 18. The first profile 16 includes an interlocking member 20 and a flange 22 extending from the interlocking member 20 on one side thereof. Similarly, the second profile 18 includes an interlocking member 24 and a flange 26 extending from the interlocking member 24 on one side thereof. As shown in FIG. 1, the zipper flanges 22, 26 extend in the same direction. The second zipper flange 26 is longer than the first 22 and is attached thereto by means of a peel seal 28.

The interlocking members 20, 24 are interlockable with each other and are designed to cooperate with the slider 14 so that they may be readily engaged and disengaged as the slider 14 is moved along the zipper 12 in the closing and opening directions, respectively. The interlocking members 20, 24 may have any shape which permits their releasable engagement. Additionally, the interlocking members 20, 24 are sealed together, or stomped, at their ends. These seals 30 ensure that the interlocking members 20, 24 do not come apart at their ends and provide ends stops for the slider 14.

Figure 1A:
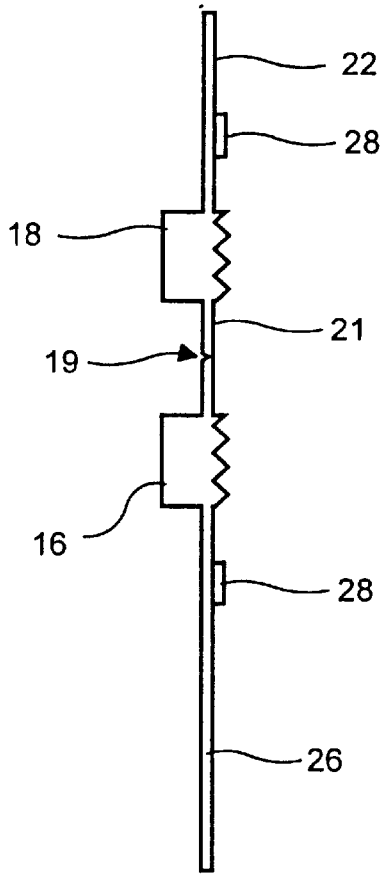
FIG. 1A is a cross sectional view of a first alternative zipper arrangement.
Figure 1B:
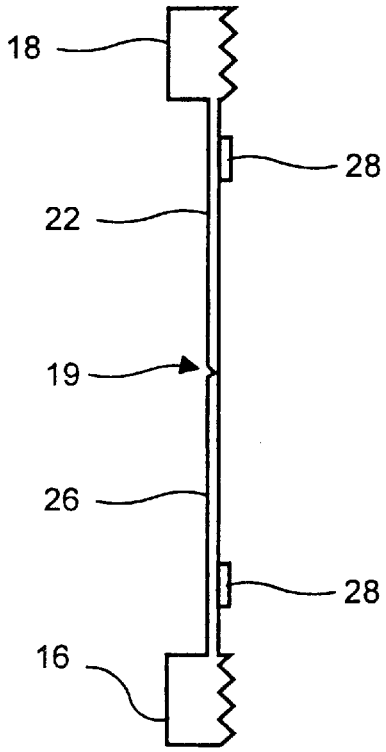
FIG. 1B is a cross sectional view of a second alternative zipper arrangement.

Preferably, the zipper flanges 22, 26 are coextruded with their corresponding interlocking members 20, 24, but may be extruded separately and attached later, such as by welding or by an adhesive. The zipper 12 and slider 14 are each made of a resilient plastic. The profiles 16, 18 may be individually extruded or extruded as a strip. If extruded as a strip the profiles may be separated as shown in FIG. 1 or may be left attached separated by a perforation line 19 for subsequent separation by the user. In the later case the perforated line could be provided in a web of film 21 between the interlocking members as shown in FIG. 1A or between the connected flanges 22 and 26 as shown in FIG. 1B.

Figure 2:
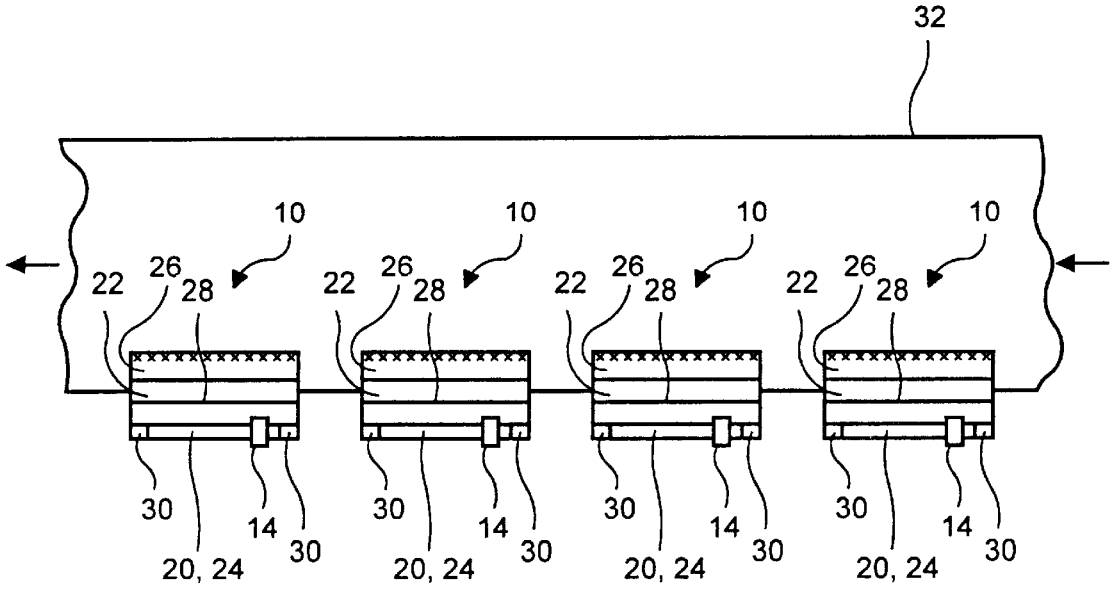
FIG. 2 is a plan view of a plurality of slide-zipper assembly lengths attached longitudinally to thermoplastic film.
Figure 12:
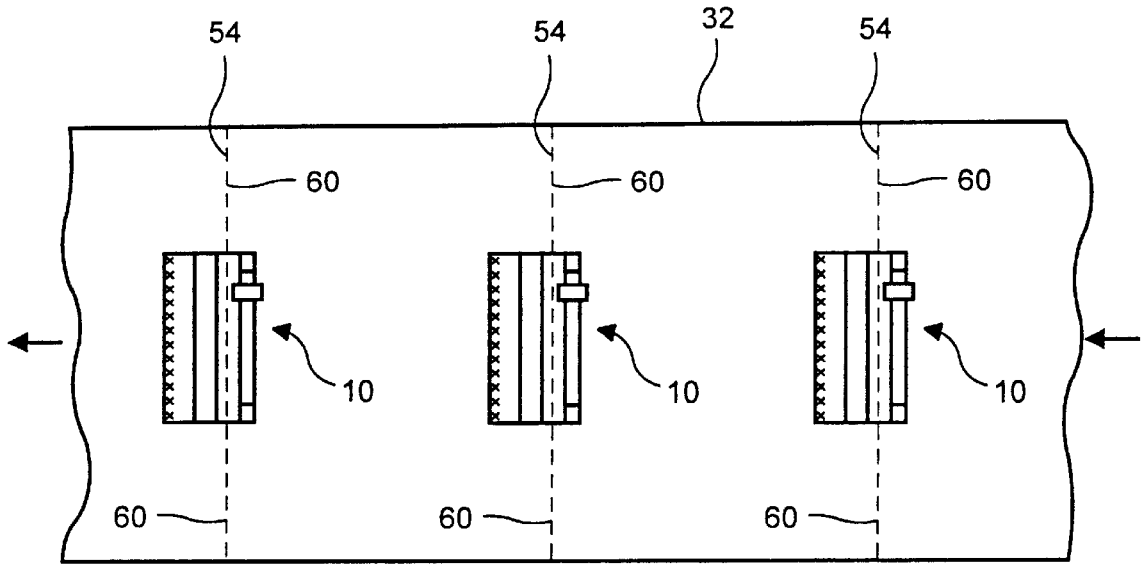
FIG. 12 is a plan view of a plurality of slide-zipper assembly lengths attached transversely to thermoplastic film in accordance with yet an alternate embodiment of the present invention.

As shown in FIG. 2, lengths of slide-zipper assembly 10 are attached to thermoplastic film 32 which may be used to make reclosable packages on an FFS machine. The slide-zipper assembly lengths 10 may be attached to the thermoplastic film 32 parallel to the running direction (indicated by the arrows), as shown in FIG. 2, or transverse to the running direction, as shown in FIG. 12. The former method is commonly known as the "longitudinal zipper" method, while the latter method is commonly known as the "transverse zipper" method.

Figure 3:
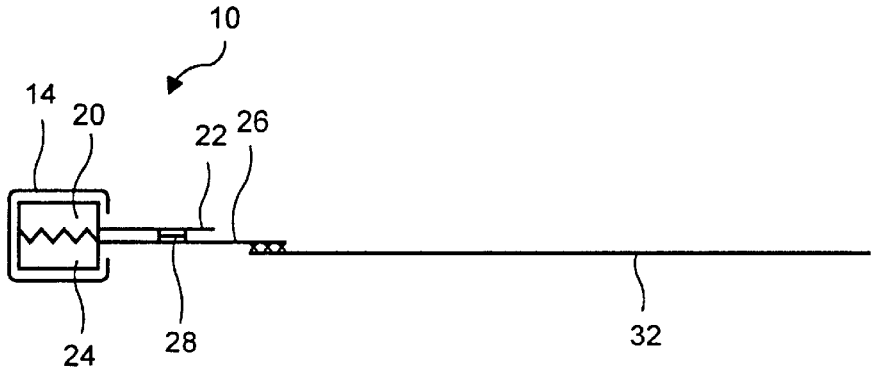
FIG. 3 is a cross-sectional view of a length of slide-zipper assembly attached longitudinally to thermoplastic film.

With respect to the longitudinal zipper method illustrated in FIG. 2, the pre-cut slide-zipper assembly lengths 10 are attached to the thermoplastic film 32 via the longer zipper flange 26. This is best illustrated in FIG. 3, which is a cross-sectional view of a length of slide-zipper assembly 10 attached to the thermoplastic film 32. As shown in FIG. 3, the longer zipper flange 26 is below the shorter flange and is attached to the thermoplastic film 32. The slider 14 and interlocking members 20, 24 hang over the edge of the film 32. The longer flange 26 is attached to the film 32, preferably by welding, which weld may either be a tack weld or a permanent weld. The weld is indicated by a series of x's. The slide-zipper assembly lengths 10 are sufficiently spaced apart from each other to allow the thermoplastic film 32 to be fed into an FFS machine and made into packages, as discussed in further detail below. Alternatively, rather than being pre-cut, the slide-zipper assembly lengths 10 may be attached to the thermoplastic film 32 from a continuous supply with the FFS machine cross-seal jaws later cutting the lengths to the proper size.

Preferably, the slide-zipper assembly lengths 10 are prepared on a machine (not shown) next to the FFS machine which cuts the slide-zipper assembly lengths 10 to size, stomps their ends and seals them to the thermoplastic film 32 as shown in FIG. 2. The machine may also be configured to apply the peel seal 28 between the zipper flanges, or the peel seal 28 may be pre-applied. The advantage of using a separate machine to prepare the slide-zipper lengths is that only minor changes, if any, need them to be made to the FFS machine. The slider may also be applied at this station.

Figure 4:
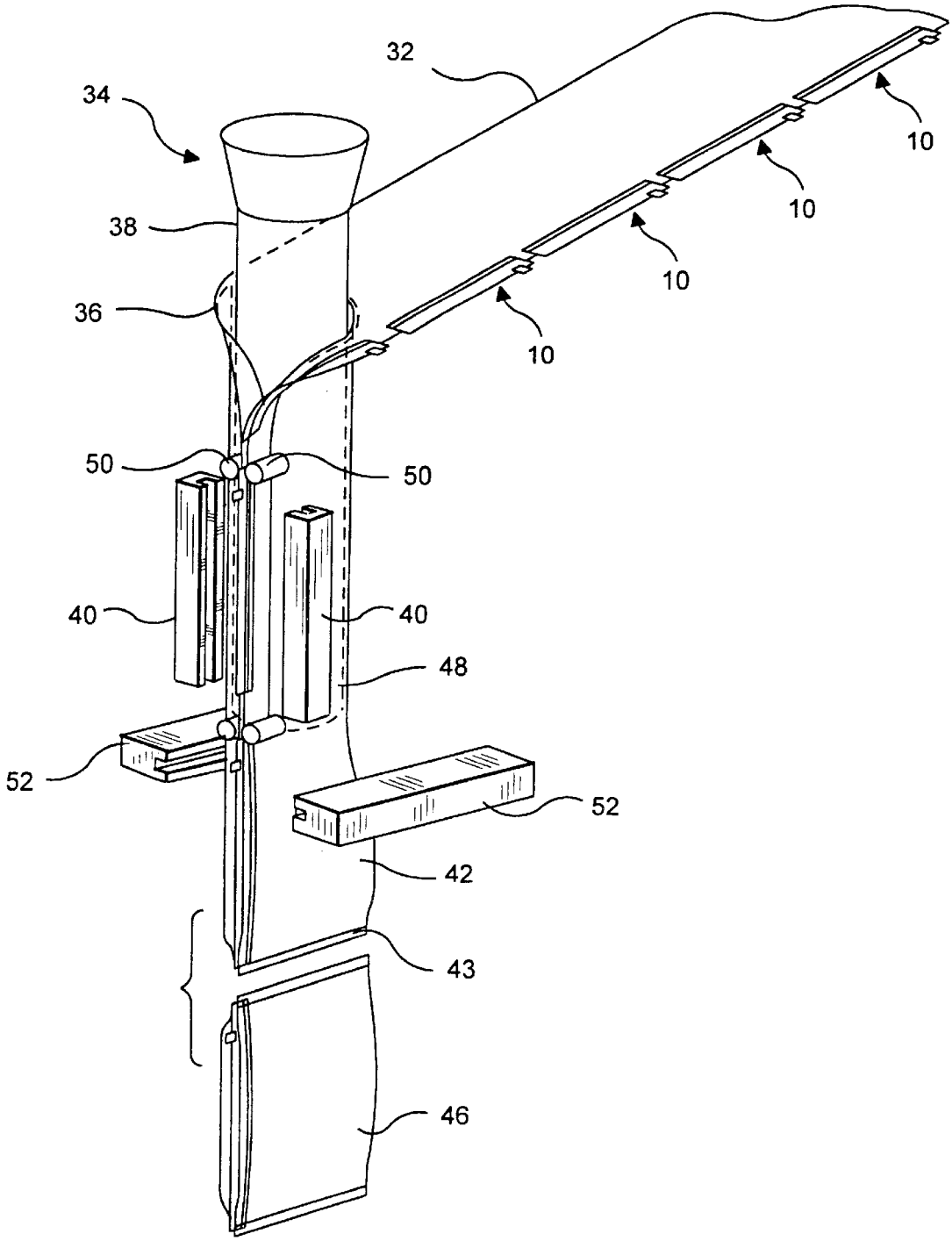
FIG. 4 is a perspective view of packages being made on an FFS machine with the thermoplastic film of FIG. 2.
Figure 5:
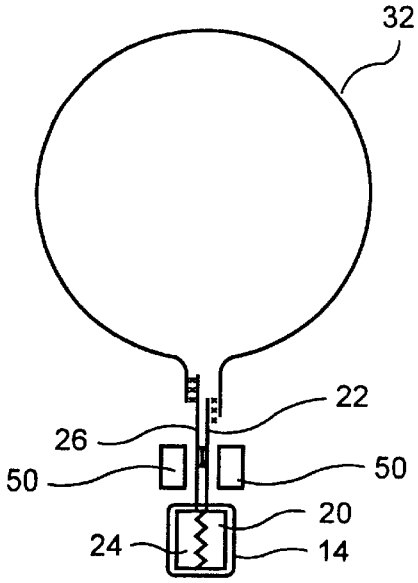
FIG. 5 is a top view of a package being made on the FFS machine of FIG. 4.
Figure 6:
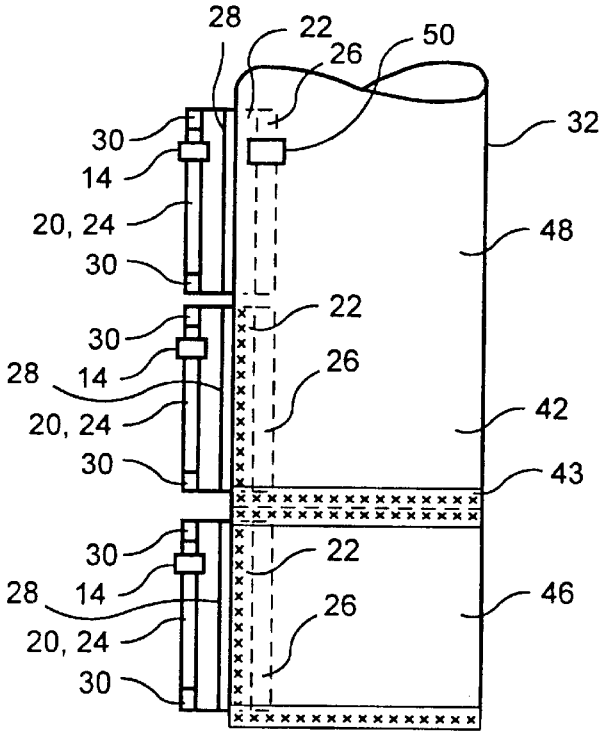
FIG. 6 is a side view of packages being made on the FFS machine of FIG. 4.

As shown in FIG. 4, the thermoplastic film 32 with the slide-zipper assembly lengths 10 thereon is fed into an FFS machine 34 where is it formed into packages. The film is fed downwardly over the forming collar 36 and around the filling tube 38 of the FFS machine. The parallel edges of the film are brought together and pressed together by a pair of rollers 50, capturing the zipper flanges 22, 26 therebetween, as more clearly shown in FIGS. 5 and 6. The edges of the film 32 are then welded to the flanges by a pair of longitudinal seal bars 40, forming what will be the top of the completed package. If the longer flange 26 was permanently welded to the thermoplastic film earlier (instead of a tack weld), then the longitudinal seal bars 40 may be configured to only seal the unsealed flange 22 to the thermoplastic film. The zipper flanges 22, 26 may be advantageously coated with adhesive which may be activated at a relatively low temperature to prevent them from being sealed together by the longitudinal seal bars 40. The flange seals are denoted by a series of x's in FIG. 6.

Contents may then dropped through the tube filling 38 into the package 42 which is presently being formed, which package has a side seal 43 which was formed when the immediately preceding package 46 was completed.

After introduction of the contents, the other side of the instant package 42 and a side of the succeeding package 48 are completed by the action of the cross seal jaws 52. The cross seal jaws 52 also include a knife portion (not shown) which cuts the completed packages from the remainder of the tube of film 32.

Figure 7:
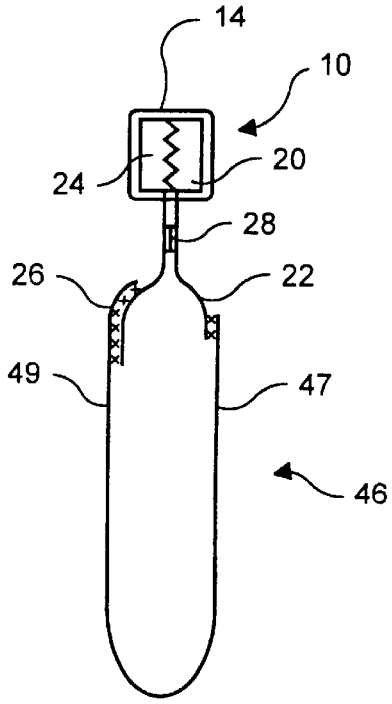
FIG. 7 is a cross-sectional view of a package made on the FFS machine of FIG. 4.

A cross-sectional view of the completed package 46 is shown in FIG. 7. As is evident from FIG. 7, the top of the package (rotated 90° from FIG. 4) is formed entirely by the slide-zipper assembly 10 and has only a peel seal 28 (rather than a pilfer evident seal) to protect the package contents. Because the zipper flanges 22, 26 form part of the package walls 47,49, the gas permeability of the flanges is necessarily a limiting feature of the package. To decrease gas permeability, the flanges can be specially co-extruded or can be made using pre-made film.

Figure 8:
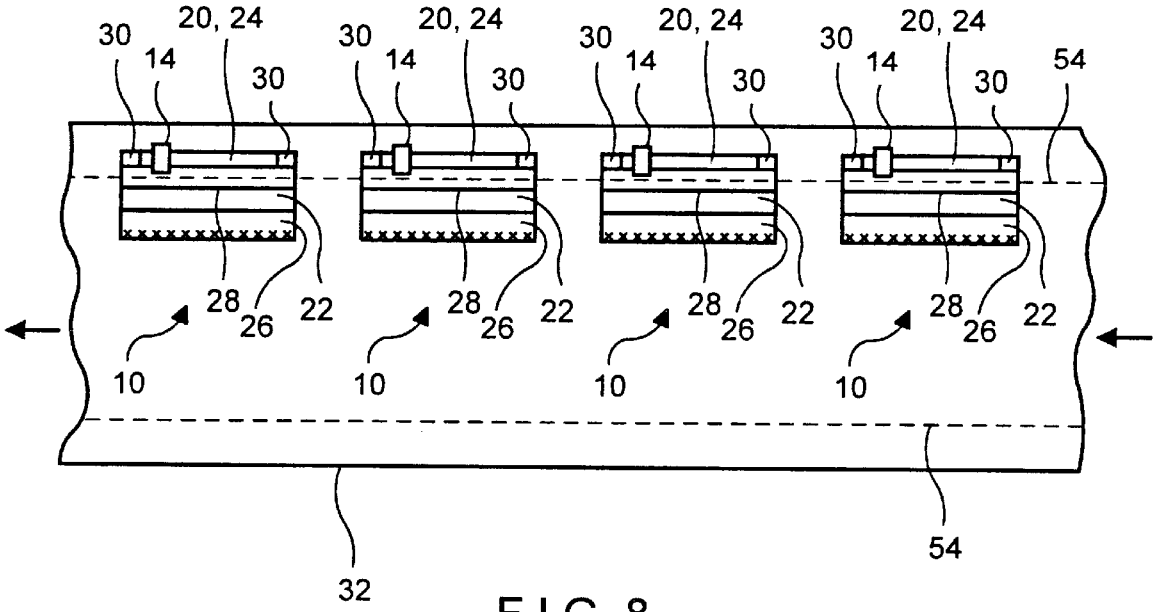
FIG. 8 is a plan view of a plurality of slide-zipper assembly lengths attached longitudinally to thermoplastic film in accordance with an alternate embodiment of the present invention.

As discussed above, the completed package 46 does not have a pilfer evident seal. If a pilfer evident seal is desired, however, wider, perforated thermoplastic film can be used. As shown in FIG. 8, the wider thermoplastic film 32 has two longitudinal perforations 54 and the longer zipper flange 26 is sealed thereto withdrawn from the edge of the film (as compared to FIG. 2) such that one of the perforations is positioned between the interlocking members 20, 24 and the portions of the zipper flanges 22, 26 which will be sealed to the package walls in the FFS machine.

Figure 9:
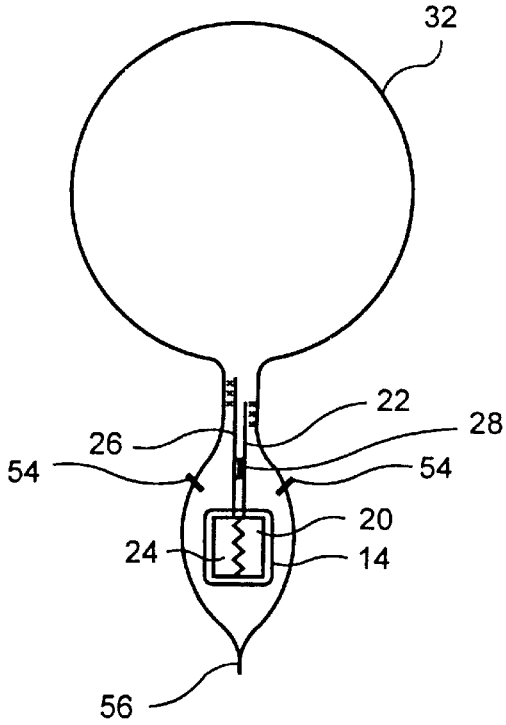
FIG. 9 is a top view of a package being made on the FFS machine of FIG. 4 using the thermoplastic film of FIG. 8.

As shown in FIG. 9, when the thermoplastic film 32 of FIG. 8 is fed into the FFS machine 34 and folded around the filling tube 38, the perforations 54 are brought into a generally opposing relationship and the edges of the wider film are sealed together by the longitudinal seal bars 40 to form a pilfer evident seal 56. When a consumer initially desires to gain access to the contents of the package, the consumer simply tears off the pilfer evident seal 56 using the perforations 54, moves the slider to the opening end of the zipper, and pulls the package walls apart to open the peel seal 28.

Figure 10:
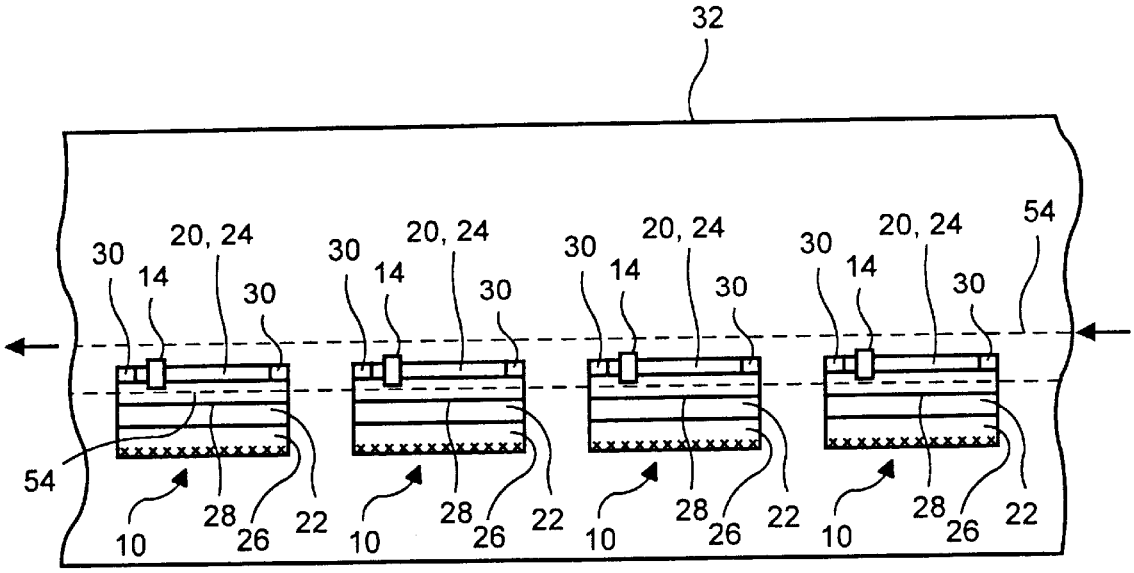
FIG. 10 is a plan view of a plurality of slide-zipper assembly lengths attached longitudinally to thermoplastic film in accordance with yet an alternate embodiment of the present invention.
Figure 11:
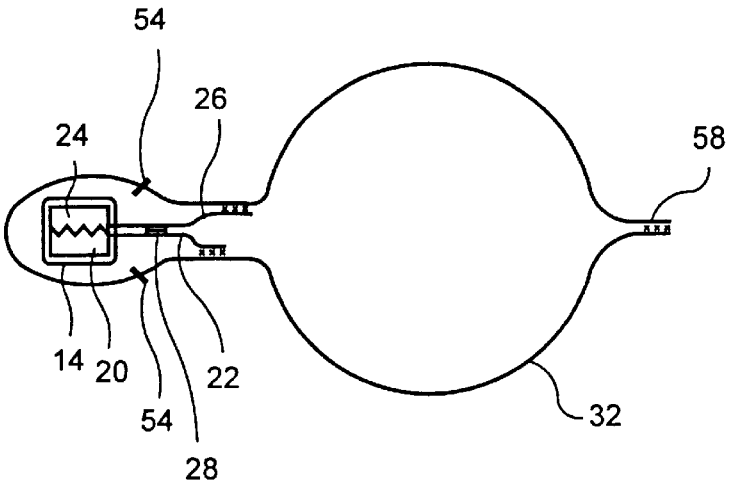
FIG. 11 is a top view of a package being formed on the FFS machine of FIG. 4 using the thermoplastic film of FIG. 9.

An alternate method of obtaining a pilfer evident seal is shown in FIGS. 10 and 11. In contrast with the embodiment of FIGS. 8 and 9, the two perforations 54 are centrally located, with one of the perforations positioned between the interlocking members 20, 24 and the portions of the flanges which will be sealed to the package walls in the FFS machine. When the film is fed into the FFS machine, the perforations are again brought into a generally opposing relationship and the edges of the film 32 are sealed together in a fin seal 58 by the longitudinal seal bars 40, as shown in FIG. 11. A second pair of longitudinal seal bars (not shown in FIG. 4) then seal the zipper flanges 22, 26 to the package walls as per the above.

Figure 13:
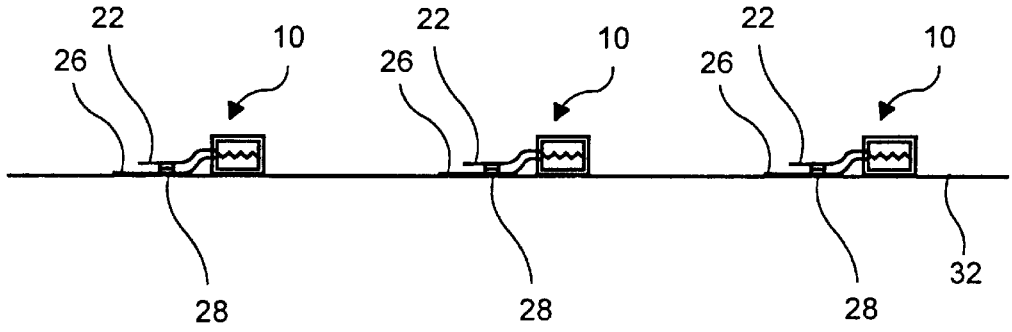
FIG. 13 is a side view of the thermoplastic film of FIG. 12.

In accordance with the present invention, it is also possible to make reclosable packages on an FFS machine wherein the slide-zipper assembly lengths 40 are positioned transverse to the running direction of the thermoplastic film 32. FIG. 12 shows a portion of thermoplastic film 32 with lengths of slide-zipper assembly 10 attached thereto. The slide-zipper assembly lengths 10 are oriented with their flanges extending in the running direction (indicated by the arrows) of the thermoplastic film. As shown in FIG. 13, which is a side view of the thermoplastic film of FIG. 12, the longer flange 26 is positioned below the shorter flange 22 and sealed to the thermoplastic film as discussed above. The slide-zipper assembly lengths 10 are sealed to the thermoplastic film 32 at package length intervals.

Since both the constructions shown in FIGS. 8 and 11 require the bag film to overlap the zipper, additionally, the thermoplastic film 32 is provided with a series of transverse perforations 54 positioned at package length increments. Each perforation is positioned between the interlocking members 20, 24 and the portions of the flanges which will be sealed to the package walls in the FFS machine. Additionally, each of the perforations includes two gaps 60 corresponding to the location of the package side folds.

Figure 14:
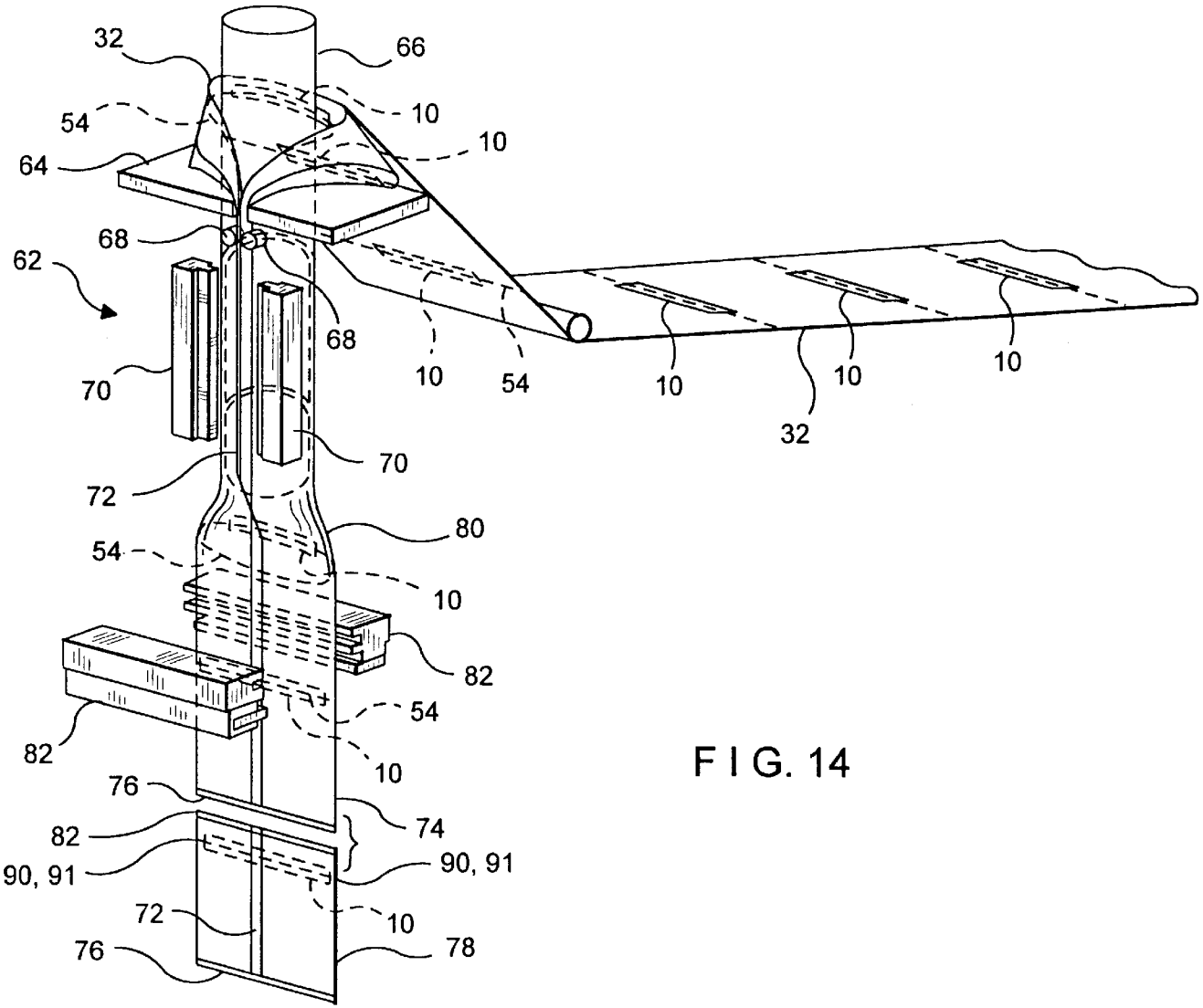
FIG. 14 is a perspective view of slide-zippered packages being made on an FFS machine with the thermoplastic film of FIG. 12.

The thermoplastic film 32 may then be fed into an FFS machine 62 configured to make transverse zippered packages. As shown in FIG. 14, the thermoplastic film 32 is fed downwardly over the collar 64 and folded around filling tube 66. The edges of the film are brought together and pressed together by a pair of rollers 68. Portions of the perforations 54 are brought into a generally opposing relationship by this action, as shown in FIG. 14. The edges are then welded together by a pair of longitudinal seal bars 70 to form a longitudinal back seal 72. Contents may then dropped through the tube 66 into the package 74 which is presently being formed, which has a lower seal 76 which was formed when the immediately preceding package 78 was completed.

After introduction of the contents, the top of the instant package 74 and the bottom of the succeeding package 80 are completed by the action of the cross seal jaws 82, which perform four simultaneous or nearly simultaneous functions.

With respect to the top of the instant package 74, the cross seal jaws 82 seal the portions of the zipper flanges 20, 26 below the peel seal to the front and back walls 84, 86 of the package 74 without sealing the flanges to each other. As discussed above, the flanges may be advantageously coated with adhesive which may be activated at a relatively low temperature to prevent the flanges from sealing to each other. The cross seal jaws 82 make the top seal of the package and spot seal and notch the sides of the bag in-line with the perforations. The cross seal jaws 82 also make the bottom seal of the succeeding package 80 and cut the completed package from the thermoplastic film 32.

Figure 15:
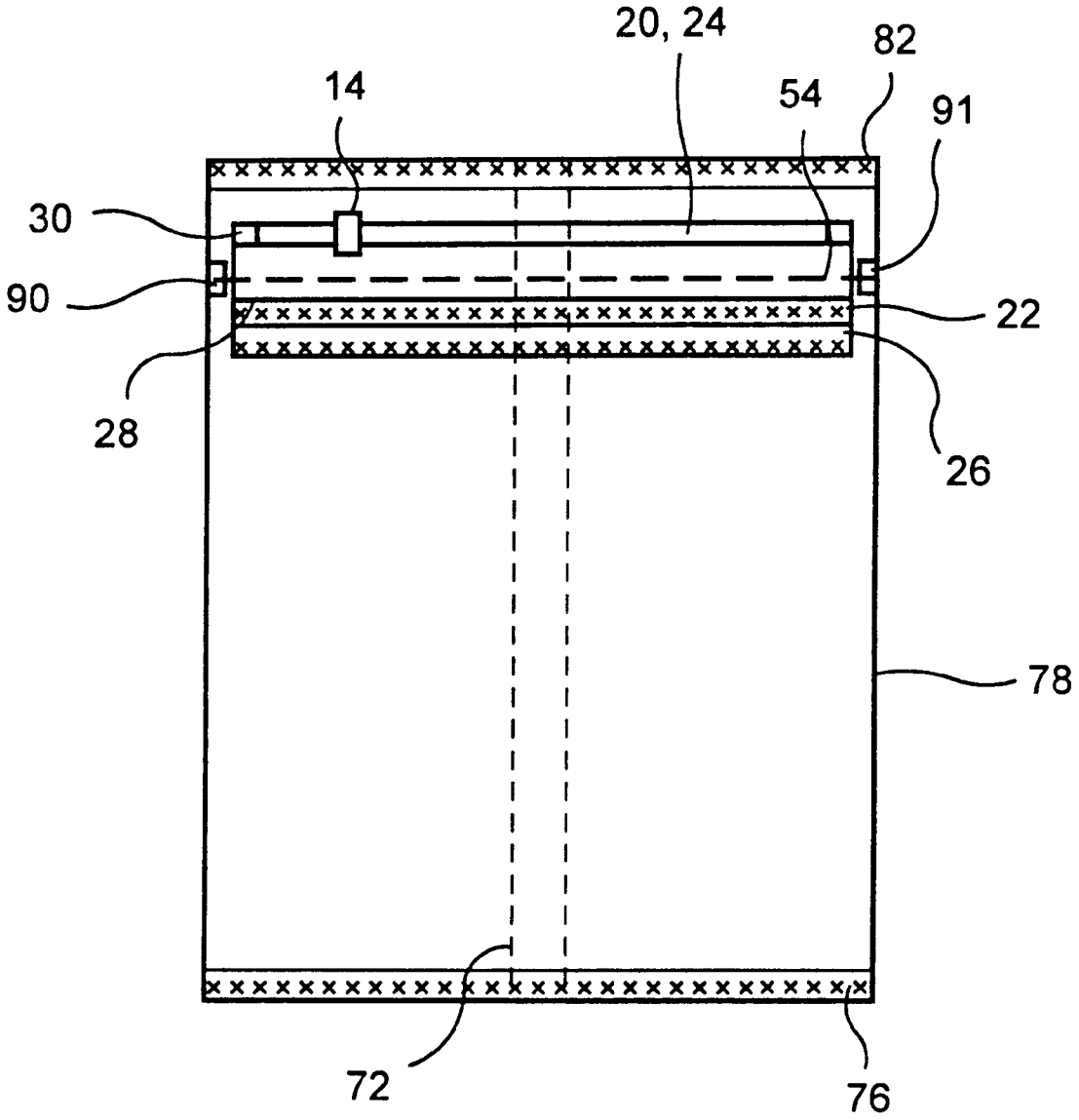
FIG. 15 is a front view of a package formed on the FFS machine of FIG. 14.
Figure 16:
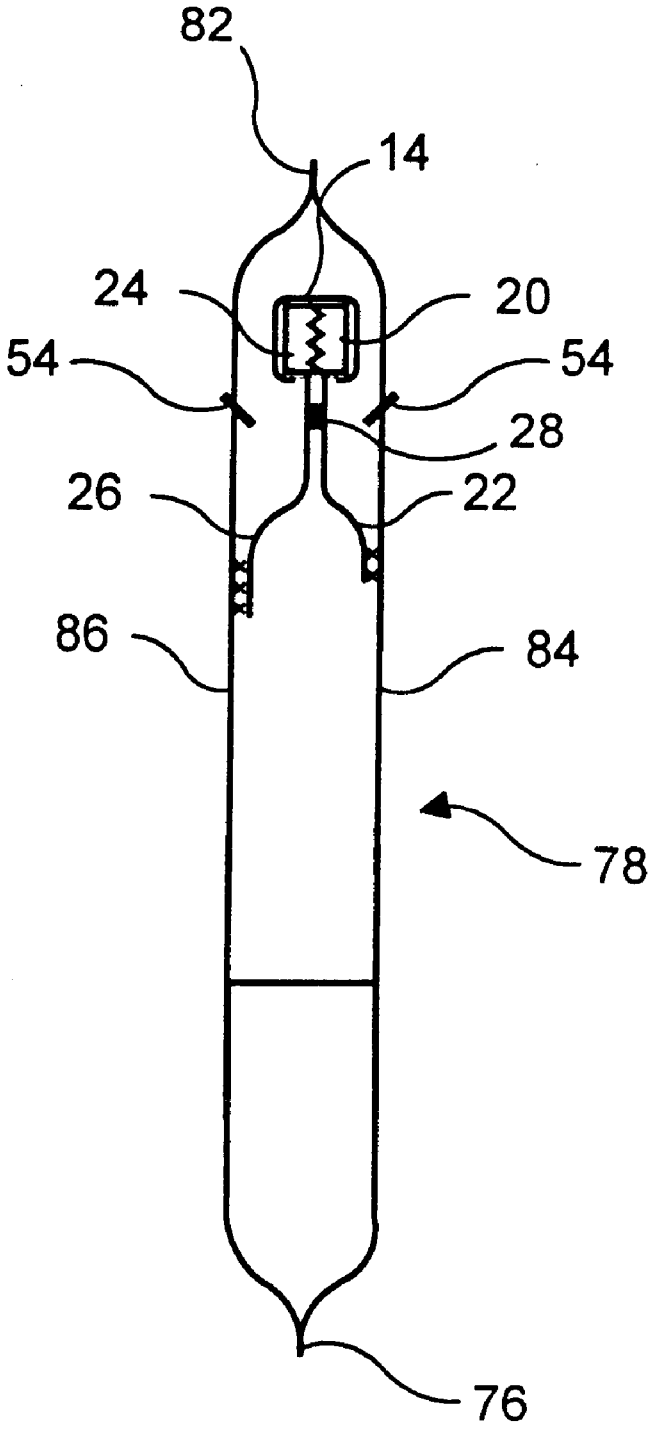
FIG. 16 is a cross-sectional view of the package of FIG. 15.

As shown in FIG. 15, the completed package 78 has a pilfer evident top seal 82, a transverse slide-zipper assembly length 10, a bottom seal 76, a longitudinal back seal 72, two spot seals and notches 90, 91 in line with the perforations 54 on the film 32, and a peal seal 28.

To initially open the sealed package 78, the consumer tears off the top seal 82 of the package along the perforations 54, using a side spot seal and notch 90, 91 to start the tear. To gain access to the interior of the package, the user moves the slider to the opening end of the zipper and pulls the package walls 84, 86 apart to open the peel seal 28.

Thus, in the foregoing manner the objects of the present invention are achieved. Modifications to the above would be obvious to those of ordinary skill in the art, but would not bring the invention so modified beyond the scope of the appended claims.

What is claimed is:

1. A method of making reclosable packages, said method comprising the steps:

providing a supply of package making material and advancing said supply in a running direction; said supply of package making material including a length of thermoplastic film and;

securing at least one reclosable zipper assembly to said thermoplastic film transverse to said running direction, said at least one reclosable zipper assembly preassembled with a first profile, a second profile; and a peel seal, said first profile including an interlocking member and a flange extending from said interlocking member; said second profile including an interlocking member interlockable with said first profile interlocking member and a flange extending from said second profile interlocking member in the same direction as said first profile flange, said second profile flange attached to said first profile flange by said peel seal; wherein the zipper assembly is secured to said thermoplastic film at said second profile flange;

folding said thermoplastic film so as to bring its longitudinal edges together;

sealing said longitudinal edges together to form a package having opposing walls;

sealing at least said first profile flange to the inner surface of one of said opposing package walls without sealing said flanges to each other;

cross-sealing the package walls to form the top of the package and the bottom of a succeeding package; and cutting the completed package from said thermoplastic film;

wherein said thermoplastic film includes at least one perforation positioned transverse to said running direction and positioned between said interlocking members and the point of attachment of said second profile flange to said thermoplastic film and wherein when said thermoplastic film is folded along said running direction to bring its longitudinal edges together and longitudinally sealed to form a tube having opposing wall portions said zipper assembly is thereby positioned between said opposing wall portions of said tube and each of said opposing wall portions includes said perforation in a generally opposing relationship and wherein said cross-sealing comprises cross-sealing said opposing wall portions at a location spaced upstream of said interlocking members so that said wall portions surround said interlocking member and said perforations are positioned between said interlocking members and the point of attachment of said profile flanges to said thermoplastic film nearest to said interlocking members.

2. The method according to claim 1 wherein said supply of package making material includes a plurality of reclosable zipper assemblies secured to said thermoplastic film at package length intervals and wherein said completed package includes only one reclosable zipper assembly.

3. A method of making reclosable packages, said method comprising the steps:

providing a supply of package making material and advancing said supply in a running direction; said supply of package making material including a length of thermoplastic film;

securing at least one reclosable zipper assembly to said thermoplastic film parallel to said running direction; said at least one reclosable zipper assembly preassembled with a first profile, a second profile and a peel seal; said first profile including an interlocking member and a flange extending from said interlocking member; said second profile including an interlocking member interlockable with said first profile interlocking member and a flange extending from said second profile interlocking member in the same direction as said first profile flange, said second profile flange attached to said first profile flange by said peel seal; wherein said zipper assembly is secured to said thermoplastic film at said second profile flange;

folding said thermoplastic film to form a package having opposing walls;

sealing first and second longitudinal edges to each other;

sealing at least said first profile flange to one of said opposing package walls to form the top of the package, each of said flanges being sealed to the inner surface of one of said opposing package walls;

cross sealing the package walls to form the sides of the package; and cutting the completed package from said thermoplastic film;

wherein said thermoplastic film includes first and second perforations parallel to said running direction, said first and second perforations being substantially equidistant from first and second longitudinal edges of said thermoplastic film, respectively, and said interlocking members of said zipper assembly are positioned (i) between said first perforation and said first longitudinal edge or (ii) between said first and second perforations; and wherein said longitudinal sealing of said edges comprises sealing said edges at a location transversely spaced from said interlocking members so that said film surrounds said interlocking members and said opposing walls include said first and second perforations, said zipper assembly is hereby positioned between said opposing walls of said package and said first and second perforations are in a generally opposing relationship with said first and second perforations positioned between said interlocking members and the point of attachment of said profile flanges to said thermoplastic film nearest to said interlocking members.

4. The method according to claim 3 wherein said supply of package making material includes a plurality of reclosable zipper assemblies secured parallel to said thermoplastic film and wherein said completed package includes only one reclosable zipper assembly.

5. The method according to claim 3 further comprising the step of cutting the portion of said reclosable zipper assembly sealed to said completed package from a remainder of said assembly.

6. The method according to claim 3 wherein said at least one reclosable zipper assembly is secured to said film at a central portion thereof.

7. The method according to claim 1, wherein said at least one reclosable zipper assembly further includes a slider disposed on said interlocking members, said slider being adapted to open the zipper as it is moved along said interlocking members in an opening direction and to close the zipper as it is moved along said interlocking members in a closing direction.

8. The method according to claim 3 wherein said at least one reclosable zipper assembly further includes a slider disposed on said interlocking members, said slider being adapted to open the zipper as it is moved along said interlocking members in an opening direction and to close the zipper as it is moved along said interlocking members in a closing direction.

* * * * *